US010161168B1

(12) United States Patent
VanRuiswyk et al.

(10) Patent No.: US 10,161,168 B1
(45) Date of Patent: Dec. 25, 2018

(54) COWLINGS AND LATCHING ASSEMBLIES FOR COWLINGS ON MARINE DRIVES

(71) Applicant: Brunswick Corporation, Mettawa, IL (US)

(72) Inventors: Brad J. VanRuiswyk, Waupun, WI (US); John D. Skroski, Oshkosh, WI (US); Devan R. Faust, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 15/831,608

(22) Filed: Dec. 5, 2017

(51) Int. Cl.

| | |
|---|---|
| ***B63H 20/32*** | (2006.01) |
| ***E05C 3/14*** | (2006.01) |
| ***E05B 73/00*** | (2006.01) |
| *E05C 19/14* | (2006.01) |
| *F02B 61/04* | (2006.01) |

(52) U.S. Cl.
CPC ..... *E05C 3/14* (2013.01); *B63H 20/32* (2013.01); *E05B 73/0076* (2013.01); *B63H 2020/323* (2013.01); *E05C 19/14* (2013.01); *F02B 61/045* (2013.01)

(58) Field of Classification Search
CPC ..... B63H 20/32; E05C 3/14; E05B 73/0076
See application file for complete search history.

(56) References Cited

U.S. PATENT DOCUMENTS

| | | | |
|---|---|---|---|
| 2,549,483 | A | 4/1951 | Kiekhaefer |
| 2,549,485 | A | 4/1951 | Kiekhaefer |
| 3,773,010 | A | 11/1973 | Elingsen |
| 4,348,194 | A | 9/1982 | Walsh |
| 4,600,396 | A | 7/1986 | Crane et al. |
| RE32,620 | E | 3/1988 | Iwai |
| 4,832,641 | A | 5/1989 | Oishi et al. |
| 4,844,031 | A | 7/1989 | Boda et al. |
| 4,875,883 | A | 10/1989 | Slattery |

(Continued)

FOREIGN PATENT DOCUMENTS

| | | |
|---|---|---|
| JP | 4024192 | 1/1992 |
| JP | 4231286 | 8/1992 |

OTHER PUBLICATIONS

Fuel-Door-Full_Open.jpg, http://www.iamaudi.com/img/Fuel-Door-Open, website visited Jul. 9, 2015.

*Primary Examiner* — Stephen P Avila
(74) *Attorney, Agent, or Firm* — Andrus Intellectual Property Law, LLP

(57) ABSTRACT

A latching assembly is for a cowl on a marine drive, the cowl having a first cowl portion and a second cowl portion that mates with the first cowl portion. A latching device is configured to latch and unlatch the first cowl portion to the second cowl portion. An actuator actuates the latching device. A flexible connector has a first end coupled to the latching device and a second end coupled to the actuator. Actuation of the actuator pulls the flexible connector to rotate a pulley and actuate the latching device. One of the first and second ends has a spherical bearing that is nested in a cylindrical bearing and seated in a cavity in the pulley. Pulling on the flexible connector pulls the spherical bearing against the cylindrical bearing such that the cylindrical bearing is pulled against the cavity in the pulley, thereby causing the pulley to rotate.

20 Claims, 5 Drawing Sheets

(56) References Cited

U.S. PATENT DOCUMENTS

| | | | | |
|---|---|---|---|---|
| 4,927,194 | A | 5/1990 | Wagner | |
| 5,102,358 | A | 4/1992 | Binversie | |
| 5,120,248 | A | 6/1992 | Daleiden et al. | |
| 5,509,836 | A | 4/1996 | Ogasawara et al. | |
| 5,697,236 | A * | 12/1997 | Kleefeldt | E05B 77/48 292/201 |
| 5,868,591 | A | 2/1999 | Kleeman | |
| 6,059,619 | A | 5/2000 | Nozue | |
| 6,167,977 | B1 * | 1/2001 | Adamson | B62D 25/10 16/289 |
| 6,390,865 | B1 | 5/2002 | Kameoka | |
| 6,488,552 | B2 | 12/2002 | Kitsu et al. | |
| 6,669,517 | B1 | 12/2003 | Alby et al. | |
| 6,682,379 | B1 | 1/2004 | Walczak et al. | |
| 6,899,579 | B1 | 5/2005 | Bruestle | |
| 7,201,623 | B1 | 4/2007 | Krupp et al. | |
| 7,210,973 | B2 | 5/2007 | Sanschagrin et al. | |
| 7,267,592 | B1 | 9/2007 | Ingebritson et al. | |
| 7,448,928 | B2 | 11/2008 | Hasegawa et al. | |
| 7,621,791 | B2 | 11/2009 | Yazaki et al. | |
| 9,580,943 | B1 | 2/2017 | Amerling et al. | |
| 9,580,947 | B1 | 2/2017 | Amerling et al. | |
| 2003/0054708 | A1 | 3/2003 | Yoshioka et al. | |
| 2013/0019402 | A1 * | 1/2013 | Vervoort | A47C 21/028 5/412 |
| 2015/0259961 | A1 * | 9/2015 | Kim | E02F 9/0891 49/192 |
| 2015/0345185 | A1 * | 12/2015 | Farooq | E05B 79/20 292/194 |
| 2018/0066461 | A1 * | 3/2018 | Nieto Avila | E05B 83/24 |

* cited by examiner

COWLINGS AND LATCHING ASSEMBLIES FOR COWLINGS ON MARINE DRIVES

FIELD

The present disclosure relates to marine drives and more particularly to cowls and latching assemblies for cowls on marine drives.

BACKGROUND

The following U.S. patents are incorporated herein by reference:

U.S. Pat. No. 9,580,943 discloses a latching device for a cowl on an outboard marine engine, the cowl having first and second cowl portions that are separated from each other in an open cowl position and that are latched together by the latching device in a closed cowl position. A retainer is adapted to be fixed to the first cowl portion and a latch is adapted to be fixed to the second cowl portion. The latch is movable into and between a latched position in which the latch is latched to the retainer and an unlatched position in which the latch is unlatched from the retainer. The latch comprises an engagement member, a bell crank, and a spring that is coupled to the engagement member and the bell crank. Movement of the bell crank with respect to the engagement member generates an over-center force on the engagement member that facilitates latching and unlatching of the engagement member and the retainer.

U.S. Pat. No. 9,580,947 discloses a cowl for an outboard marine propulsion device having an internal combustion engine. The cowl comprises a first cowl portion; a second cowl portion that mates with the first cowl portion to enclose the internal combustion engine; a service door on the second cowl portion, wherein the service door is position-able in an open position and in a closed position; and a carrying handle on the second cowl portion, wherein the carrying handle is accessible when the service door is in the open position and inaccessible when the service door is in the closed position. A plurality of latches is spaced apart around the perimeter. The latches latch the second cowl portion to the first cowl portion. An actuator assembly actuates each of the plurality of latches. The actuator assembly can be actuated by movement of the carrying handle.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

A latching assembly is for a cowl on a marine drive, the cowl having a first cowl portion and a second cowl portion that mates with the first cowl portion to enclose the marine drive. The latching assembly comprises a latching device configured to latch and unlatch the first cowl portion to the second cowl portion; an actuator that actuates latching device; and a flexible connector having a first end coupled to the latching device and a second end coupled to the actuator. Actuation of the actuator pulls the flexible connector to rotate a pulley and thereby actuate the latching device. One of the first and second ends comprises a spherical bearing that is nested in a cylindrical bearing. The spherical bearing and cylindrical bearing are seated in a cavity in the pulley. Pulling on the flexible connector pulls the spherical bearing against the cylindrical bearing such that the cylindrical bearing is pulled against the cavity in the pulley thereby causing the pulley to rotate.

DETAILED DESCRIPTION OF THE DRAWINGS

Figure 1:
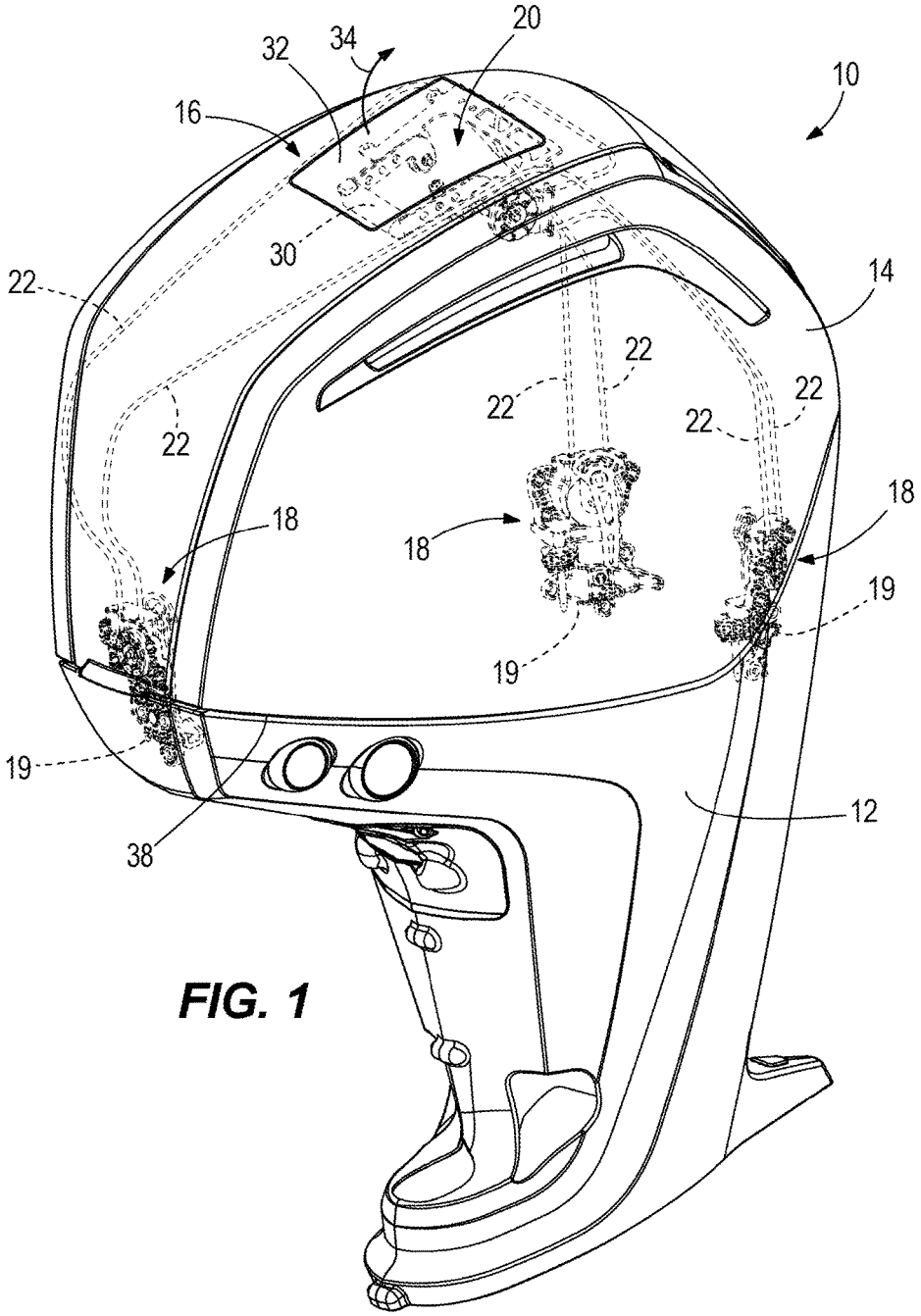
FIG. 1 is a perspective view of an exemplary cowl and latching assembly according to the present disclosure.
Figure 2:
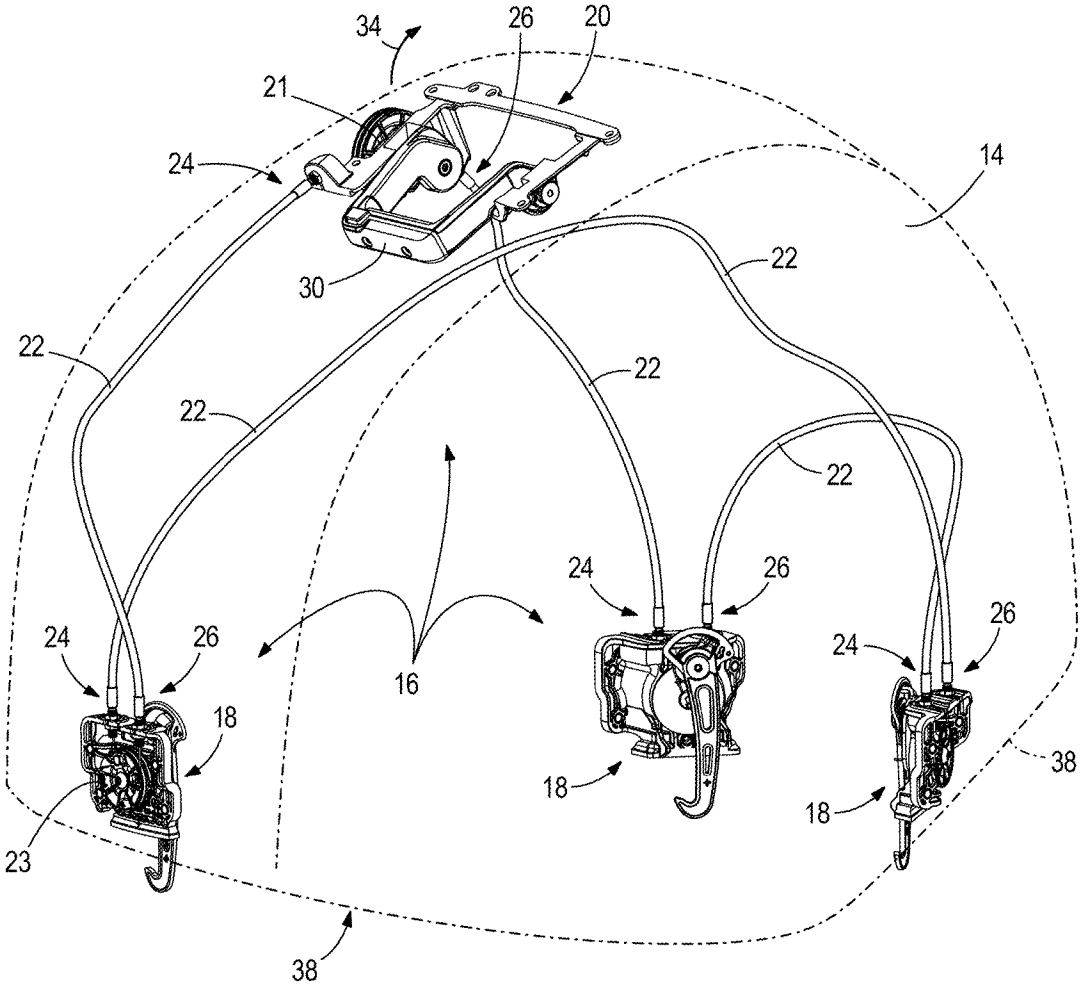
FIG. 2 is a perspective view of the latching assembly.
Figure 3:
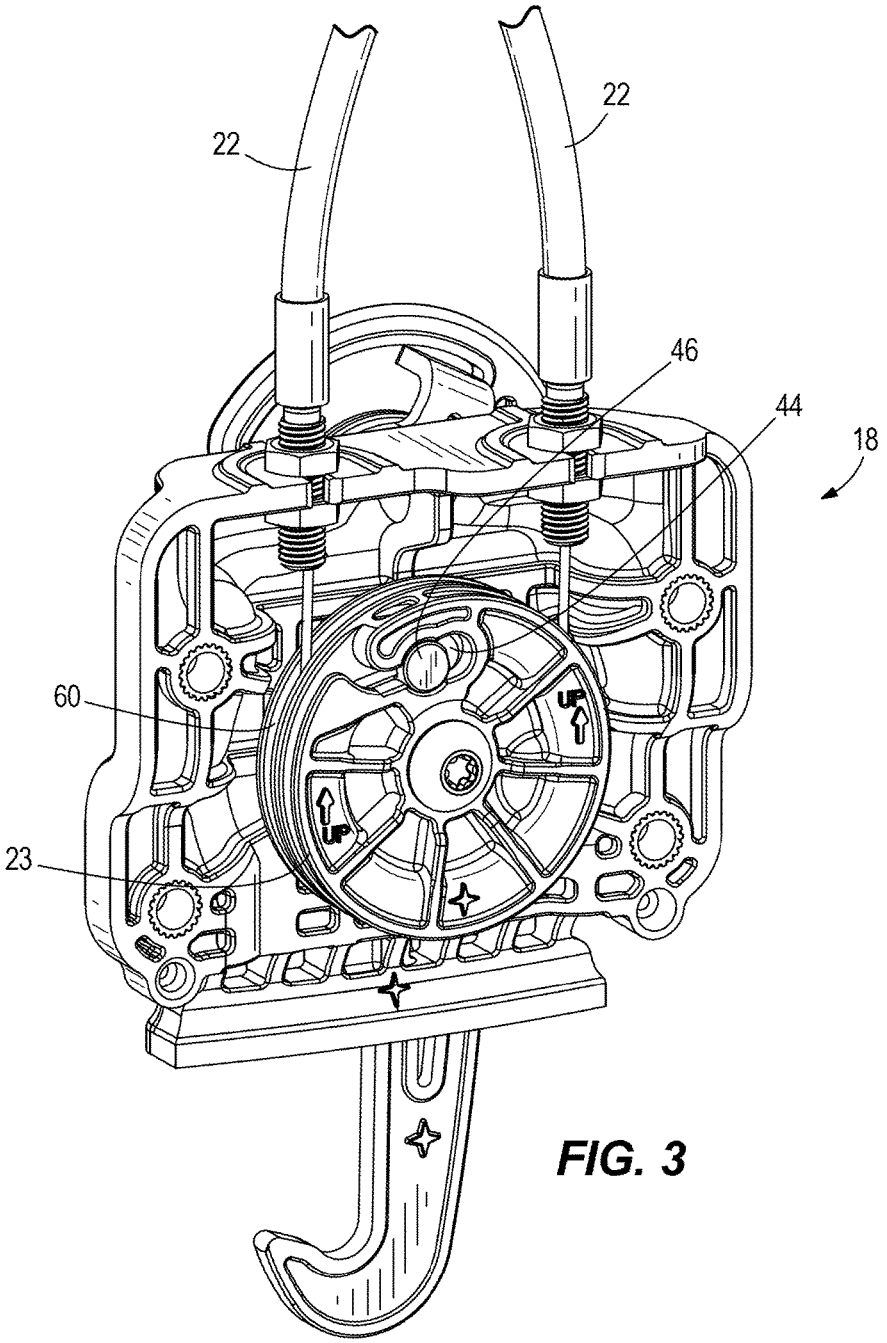
FIG. 3 is a rear perspective view of an exemplary latching device according to the present disclosure.

FIGS. 1 and 2 depict an exemplary cowl 10 for an outboard marine drive. The cowl 10 has a lower cowl portion 12 and an upper cowl portion 14 that is mated with the lower cowl portion 12 to enclose, for example, an internal combustion engine associated with the outboard marine drive. FIGS. 1 and 2 also depict a latching assembly 16 for latching the upper cowl portion 14 to the lower cowl portion 12 in the mated position shown in FIG. 1. Just like the latching arrangements in the incorporated U.S. Pat. Nos. 9,580,943 and 9,580,947, the latching assembly 16 includes a plurality of latching devices 18 that are configured to latch and unlatch the upper cowl portion 14 to the lower cowl portion 12. The latching devices 18 are spaced apart around a perimeter 38 of the upper cowl portion 14, and each one is movable into and between a latched position (FIG. 1) in which the latching device 18 is latched to the corresponding retainer 19 on the lower cowl portion 12 and an unlatched position in which the latching device 18 is unlatched from the retainer 19, all as described in the above-incorporated U.S. Patents.

The latching assembly 16 also has an actuator 20, which is configured to actuate the latching devices 18 via a plurality of flexible connectors 22. Each flexible connector 22 has a first end 24 coupled to either the actuator 20 or a respective latching device 18 and a second end 26 coupled to either the actuator 20 or to another latching device 18. The actuator 20, plurality of flexible connectors 22 and plurality of latching devices 18 are connected together in a "daisy-chain" arrangement, i.e., wherein actuation of the actuator 20 actuates all of the latching devices 18. Specifically, actuation of the actuator 20 rotates a pulley 21 on the actuator 20, which pulls on a respective flexible connector 22 to thereby rotate a corresponding pulley 23 on a first one of the respective latching devices 18, which pulls on a next flexible connector 22 in the chain, etc.

As described in U.S. Pat. No. 9,580,947, the actuator 20 includes a carrying handle 30 located in a pocket extending into the top of the upper cowl portion 14. The pocket is covered by a service door 32. The service door 32 is manually pivotable, as shown by arrow 34, between a closed position (not shown) in which the carrying handle 30 is covered and an open position in which the carrying handle 30 is exposed for use. When the service door 32 is moved into the open position, the carrying handle 30 is manually pivotable from the retracted position shown in FIG. 2 to an extended position (not shown), wherein the carrying handle 30 extends from the pocket. Pivoting of the carrying handle 30 rotates the pulley 21, thus actuating the latching devices 18 via the connectors 22, as summarized above and more fully described in U.S. Pat. No. 9,580,947.

The actuator 20 is operatively connected to each of the latching devices 18 via the flexible connectors 22 and the pulleys 21, 23. The flexible connectors 22 connect each of the pulleys 21, 23 together in the above-described pull-pull, daisy-chain arrangement, wherein pivoting of the carrying handle 30 from the retracted position to the extended position rotates the pulley 21, which pulls on one side of the chain of flexible connectors 22 and causes corresponding rotation of the pulleys 23 on the respective latching devices 18. Pivoting of the carrying handle 30 from the extended position to the retracted position rotates the pulley 21 in an opposite direction, thus pulling on the other side of the chain of flexible connector 22 and causing opposite rotation of the pulleys 23.

Figure 4:
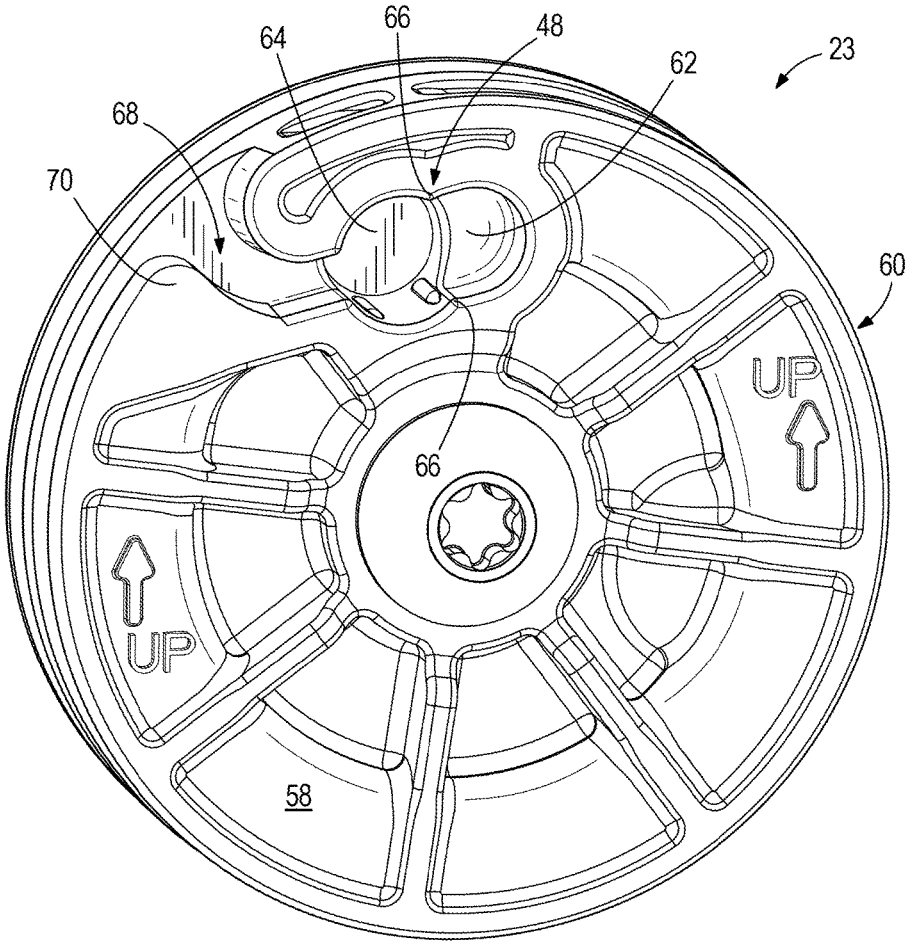
FIG. 4 is a rear perspective view of a pulley according to the present disclosure.
Figure 5:
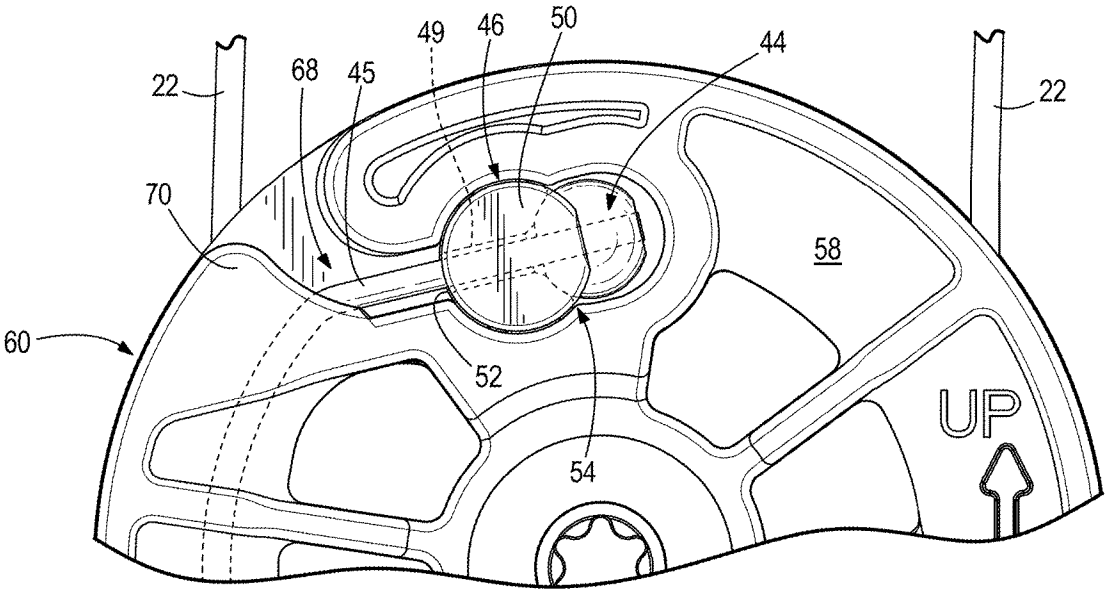
FIG. 5 is a partial view of the pulley.
Figure 6:
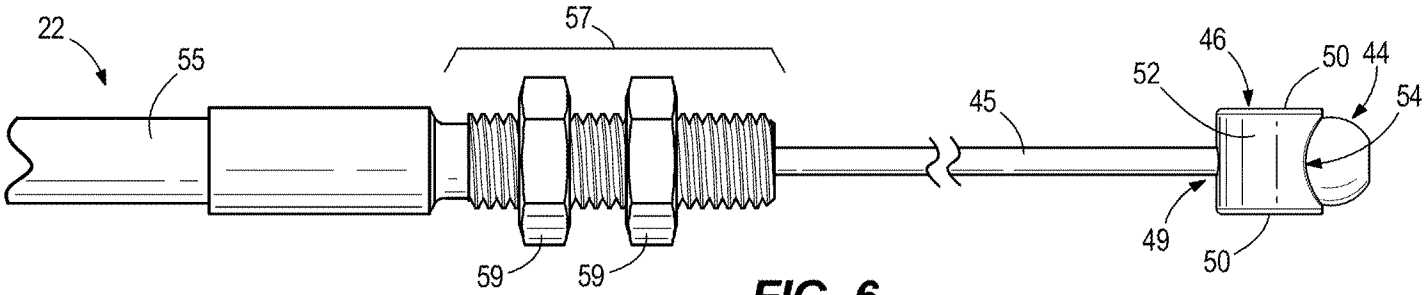
FIG. 6 is a partial view of an exemplary flexible connector according to the present disclosure.

FIGS. 4 and 5 depict an exemplary pulley 23 on the latching assembly 16. FIG. 6 depicts an end of the flexible connector 22, which for example can be the end of the flexible connector 22 connected to the pulley 21 or end connected to the pulley 23. That is, although certain descriptions provided herein below are made in reference to the pulley 23, the concepts are equally applicable to the pulley 21. The manner of connection between the flexible connector 22 and the pulley 21 can be identical to the manner of connection between the flexible connector 22 and the pulleys 23.

During research and experimentation with the above-described latching assembly 16, the present inventors made several discoveries. It is desirable to form the flexible connector as a braided stainless steel wire that is coated with a protective plastic covering. This gives the flexible connector the necessary strength under high tension loads and also protects it from deleterious effects of the harsh marine environment. It was also found to be desirable to make the pulleys out of plastic, thus saving manufacturing costs and providing a relatively lightweight assembly compared to metal parts. It followed that U.S. Pat. Nos. 9,580,943 and 9,580,947 disclosed this type of arrangement, including braided stainless steel wires having swaged ball ends that are seated in recesses in plastic pulleys. However during further experimentation, the present inventors also determined that, in use, this arrangement had certain drawbacks. It is necessary for the latching assembly to enact high latching loads to securely couple the upper cowl portion to the lower cowl portion—so that the upper cowl portion remains secured to the lower cowl portion during rough water running, log strike situations, etc. However with the requisite high latching loads, the swaged ball ends of the stainless steel wires tend to deform or embed into the plastic pulleys, which reduces the tension in the wires and potentially destroys the functionality of the latching device.

Referring now to FIG. 6, according to the present invention, the ends of the flexible connector 22 include a spherical bearing 44 that is nested in a cylindrical bearing 46. Preferably, the flexible connector 22 is a braided stainless steel wire 45 and the spherical bearing 44 is a stainless steel ball that is crimped to the end of the wire 45 in 360 degrees crimping force around the ball. The cylindrical bearing 46 has a through-bore 49 through which the flexible connector 22 extends, preferably such that the cylindrical bearing 46 is slide-able back and forth along the wire 45 with respect to the spherical bearing 44. This provides the access necessary during manufacture to crimp the spherical bearing 44 in 360 degrees about its circumference. The cylindrical bearing 46 includes opposing end walls 50, tubular sidewalls 52 and a cavity 54 in the sidewalls 52. The through-bore 49 extends from the cavity 54 to the sidewalls 52 opposite the cavity, so that the spherical bearing 44 is guided into the seated position in the cavity 54 shown in FIG. 6. The outer curvature of the spherical bearing 44 matches the inner curvature of the cavity 54 so that the spherical bearing 44 snugly fits in the cavity 54. The flexible connector 22 is housed within a protective jacket 55 and has an expansion/retraction joint 57 having rotatable nuts 59 for increasing or decreasing the axial tension on the flexible connector 22, by loosening or tightening the cylindrical connector 22 once the ends 24 of the flexible connector 22 are connected to respective pulleys 21, 23.

As shown in FIGS. 4 and 5, the spherical bearing 44 and cylindrical bearing 46 are seated together in a cavity 48 formed in one of the opposing pulley wheel sidewalls 58. The cavity 54 extends into and includes a spherical segment-shaped recess 62 into which the spherical bearing 44 is nested. The cavity 54 includes a cylindrical-shaped recess 64 into which the cylindrical bearing 46 is nested. The cylindrical-shaped recess 64 defines opposing retention ribs 66 that face each other and retain the cylindrical bearing 46 in the cavity 54 when the flexible connector 22 is placed under tension. The spherical segment-shaped recess 62 and the cylindrical-shaped recess 64 are adjacent each other. A bridge passage 68 connects the cavity 54 to the pulley wheel track. The flexible connector 22 extends from the cavity 54, through the bridge passage 68, and then around the peripherally outer pulley wheel track 60. A rib 70 extends over the bridge passage 68 and prevents the flexible connector 22 from falling out of the bridge passage 68 when the flexible connector 22 is not under tension. The rib 70 extends transversely over the bridge passage 68 to thereby secure the flexible connector 22 therein.

In this arrangement, pulling on the flexible connector 22, for example via rotation of the carrying handle 30, pulls the spherical bearing 44 against the cylindrical bearing 46 such that the cylindrical bearing 46 is pulled against the cavity 48 in the respective pulley 21, 23, thereby causing the pulleys 21, 23 to rotate. The pulleys 21, 23 include a pulley wheel 56 having opposing pulley wheel sidewalls 58 and a peripherally outer pulley wheel track 60 around which the flexible connector 22 rides. The spherical bearing 44 holds and evenly distributes the pulling load into the cavity 54 of the cylindrical bearing 46. The cylindrical bearing 46 evenly distributes the resultant force to the cavity 48 via engagement between the tubular sidewalls 52 and the cylindrical segment-shaped recess 64 in a manner that reduces or eliminates stress risers. The retention ribs 66 facilitate retention of the flexible connector 22 with respect to the pulley 21, 23

In the present description, certain terms have been used for brevity, clearness and understanding. No unnecessary limitations are to be implied therefrom beyond the requirement of the prior art because such terms are used for descriptive purposes only and are intended to be broadly construed. The different systems, methods and apparatuses described herein may be used alone or in combination with other systems, methods and apparatuses. Various equivalents, alternatives and modifications are possible within the scope of the appended claims.

What is claimed is:

1. A latching assembly for a cowl on a marine drive, the cowl having a first cowl portion and a second cowl portion that mates with the first cowl portion to enclose the marine drive, the latching assembly comprising:

a latching device configured to latch and unlatch the second cowl portion to the first cowl portion;

an actuator that actuates latching device; and a flexible connector having a first end coupled to the latching device and a second end coupled to the actuator, wherein actuation of the actuator rotates a pulley and thereby actuates the latching device;

wherein one of the first and second ends comprises a spherical bearing that is nested in a cylindrical bearing, wherein the spherical bearing and cylindrical bearing are seated in a cavity in the pulley, and wherein pulling on the flexible connector pulls the spherical bearing against the cylindrical bearing such that the cylindrical bearing is pulled against the cavity in the pulley, thereby causing the pulley to rotate.

2. The latching assembly according to claim 1, wherein the flexible connector comprises a wire and the spherical bearing is crimped to the wire.

3. The latching assembly according to claim 1, wherein the cylindrical bearing comprises opposing end walls, a tubular sidewall that extends between the opposing end walls, and a cavity in the sidewall, wherein the spherical bearing is seated in the cavity.

4. The latching assembly according to claim 3, wherein the pulley comprises pulley wheel having opposing pulley wheel sidewalls and a peripherally outer pulley wheel track around which the flexible connector rides.

5. The latching assembly according to claim 4, wherein the cavity extends into one of the opposing pulley wheel sidewalls.

6. The latching assembly according to claim 5, wherein the cavity comprises a spherical-segment-shaped recess into which the spherical bearing is nested.

7. The latching assembly according to claim 6, wherein the cavity further comprises a cylindrical-shaped recess into which the cylindrical bearing is nested.

8. The latching assembly according to claim 7, wherein the cylindrical-shaped recess defines a plurality of opposing retention ribs that retain the cylindrical bearing in the cavity when the flexible connector is under tension.

9. The latching assembly according to claim 7, wherein the spherical-segment-shaped recess and cylindrical-shaped recess are adjacent each other.

10. The latching assembly according to claim 4, further comprising a bridge passage that connects the cavity to the peripherally outer pulley wheel track, wherein the flexible connector extends from the cavity, through the bridge passage and around the peripherally outer pulley wheel track.

11. The latching assembly according to claim 9, further comprising a rib that extends over the bridge passage and prevents the flexible connector from falling out of the bridge passage when the flexible connector is not under tension.

12. The latching assembly according to claim 1, wherein the pulley is on the actuator.

13. The latching assembly according to claim 1, wherein the pulley is on the latching device.

14. The latching assembly according to claim 1, wherein the pulley is made of plastic and the spherical bearing and cylindrical bearing are made of stainless steel.

15. A cowl for a marine drive, the cowl comprising:

a first cowl portion and a second cowl portion that mates with the first cowl portion to enclose the marine drive; and a latching assembly comprising:

a latching device configured to latch and unlatch the second cowl portion to the first cowl portion;

an actuator that actuates latching device; and a flexible connector having a first end coupled to the latching device and a second end coupled to the actuator, wherein actuation of the actuator rotates a pulley and thereby actuates the latching device;

wherein one of the first and second ends comprises a spherical bearing that is nested in a cylindrical bearing, wherein the spherical bearing and cylindrical bearing are seated together in a cavity in the pulley, and wherein pulling on the flexible connector pulls the spherical bearing against the cylindrical bearing such that the cylindrical bearing is pulled against the cavity in the pulley, thereby causing the pulley to rotate.

16. The cowl according to claim 15, wherein the pulley comprises pulley wheel having opposing pulley wheel sidewalls and a peripherally outer pulley wheel track around which the flexible connector rides, and wherein the cavity extends into one of the opposing pulley wheel sidewalls.

17. The cowl according to claim 16, wherein the cavity comprises a spherical-segment-shaped recess into which the spherical bearing is nested, a cylindrical-shaped recess into which the barrel is nested, and a bridge passage that connects the cavity to the peripherally outer pulley wheel track, wherein the flexible connector extends from the cavity, through the bridge passage, and around the peripherally outer pulley wheel track.

18. The cowl assembly according to claim 17, further comprising a rib that extends over the bridge passage and prevents the flexible connector from falling out of the bridge passage when the flexible connector is not under tension.

19. The cowl according to claim 17, wherein the cylindrical-shaped recess defines a plurality of opposing retention ribs that retain the cylindrical bearing in the cavity when the flexible connector is under tension.

20. The latching assembly according to claim 1, wherein the pulley is on the actuator and further comprising another pulley on the latching device that is configured the same as the pulley on the actuator.

* * * * *